US011305403B2

(12) United States Patent
Lin et al.

(10) Patent No.: US 11,305,403 B2
(45) Date of Patent: Apr. 19, 2022

(54) VISE JAW

(71) Applicants: Chang-Yi Lin, Taichung (TW); Chang-Chih Lin, Taichung (TW)

(72) Inventors: Chang-Yi Lin, Taichung (TW); Chang-Chih Lin, Taichung (TW)

( * ) Notice: Subject to any disclaimer, the term of this patent is extended or adjusted under 35 U.S.C. 154(b) by 335 days.

(21) Appl. No.: 16/554,358

(22) Filed: Aug. 28, 2019

(65) Prior Publication Data

US 2021/0060733 A1 Mar. 4, 2021

(51) Int. Cl.
*B25B 1/24* (2006.01)
*B25B 1/02* (2006.01)

(52) U.S. Cl.
CPC ..... *B25B 1/2405* (2013.01); *B25B 1/02* (2013.01); *B25B 1/2452* (2013.01); *B25B 1/241* (2013.01)

(58) Field of Classification Search
CPC ..... B25B 1/2405; B25B 1/2452; B25B 1/24; B25B 5/16; B25B 5/163; B25B 1/02; B25B 1/241
USPC ..... 269/282, 283
See application file for complete search history.

(56) References Cited

U.S. PATENT DOCUMENTS 5,226,637 A * 7/1993 Kitaura ..... B25B 5/08 269/234
8,540,225 B2 * 9/2013 Ehnstrom ..... B25B 1/2452 269/282
9,630,299 B1 * 4/2017 Lien ..... B25B 1/2452

OTHER PUBLICATIONS

Tormach CaerveSmart Jaws (Year: 2016).*

* cited by examiner

*Primary Examiner* — Mahdi H Nejad
(74) *Attorney, Agent, or Firm* — Muncy, Geissler, Olds & Lowe, PC

(57) ABSTRACT

A vise jaw is provided, including: a first jaw, including a slide groove and at least one locking portion, each locking portion including a receiving room, a threaded hole and a through hole, the receiving room, the threaded hole and the through hole respectively communicated with each other; a second jaw, having a slide protrusion slidably disposed within the slide groove, the slide protrusion having a lateral face facing the through hole; at least one fastening assembly, each fastening assembly including a screw member, an abutting member and at least one elastic member, the screw member screwed into the threaded hole, the abutting member adjustably disposed within the receiving room, the abutting member including a large diameter section and a small diameter section which are arranged along a first direction, the small diameter section disposed through the through hole and extending into the slide groove.

8 Claims, 13 Drawing Sheets

VISE JAW

BACKGROUND OF THE INVENTION

Field of the Invention

The present invention relates to a vise jaw.

Description of the Prior Art

A vise jaw is used for clamping a workpiece during manufacturing or processing. A conventional vise jaw includes two fixing seats and two clamp boards which are respectively mounted to one of the two fixing seats, and thus the workpiece is clamped by the two clamp boards.

The conventional vise jaw further includes a plurality of bolts each screwed into one of the two clamp boards and one of the two fixing seats, wherein mounting of the plurality of bolts are carried out within a space between the two clamp boards. However, the space which is between the two clamp boards is too small to operate a screw driver. As a result, it is hard to use the screw driver for assembling or disassembling the clamp boards to the two fixing seats.

The present invention is, therefore, arisen to obviate or at least mitigate the above mentioned disadvantages.

SUMMARY OF THE INVENTION

An object of the present invention is to provide a vise jaw which is easy to assemble or disassemble.

To achieve the above and other objects, a vise jaw is provided, including: a first jaw, including a slide groove and at least one locking portion, each of the at least one locking portion including a receiving room, a threaded hole and a through hole, the receiving room, the threaded hole and the through hole respectively communicated with each other; a second jaw, having a slide protrusion slidably disposed within the slide groove, the slide protrusion having a lateral face facing the through hole; at least one fastening assembly, each of the at least one fastening assembly including a screw member, an abutting member and at least one elastic member, the screw member screwed into the threaded hole, the abutting member adjustably disposed within the receiving room, the abutting member including a large diameter section and a small diameter section, the large diameter section and the small diameter section arranged along a first direction, the small diameter section disposed through the through hole and extending into the slide groove; wherein the screw member is screwed to move in the first direction to press the abutting member so that the small diameter section of the abutting member is moved relatively to the through hole to press the lateral face, at least one said elastic member elastically abuts between the abutting member and an inner wall of the receiving room.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
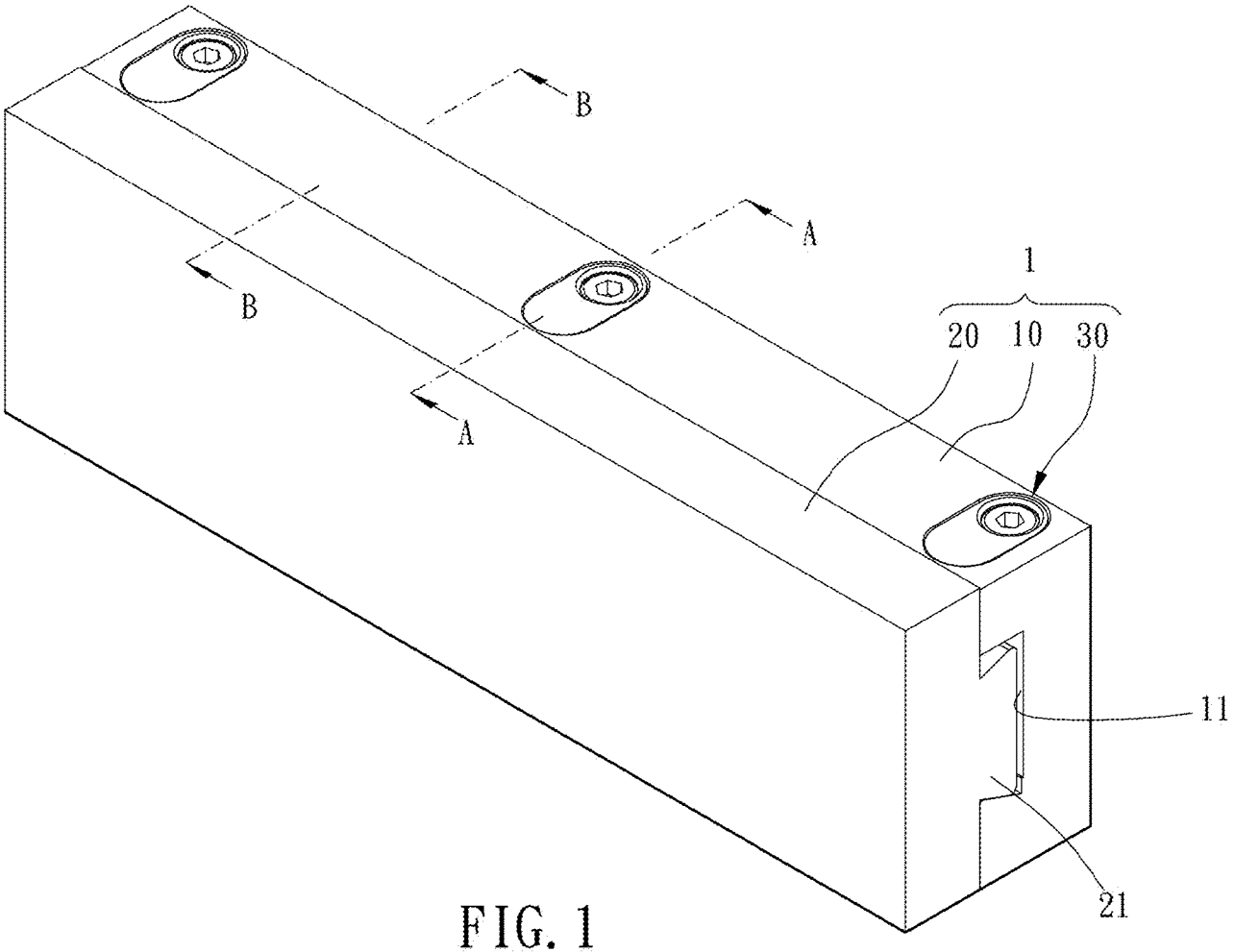
FIG. 1 is a perspective view according to a first embodiment of the present invention.
Figure 2:
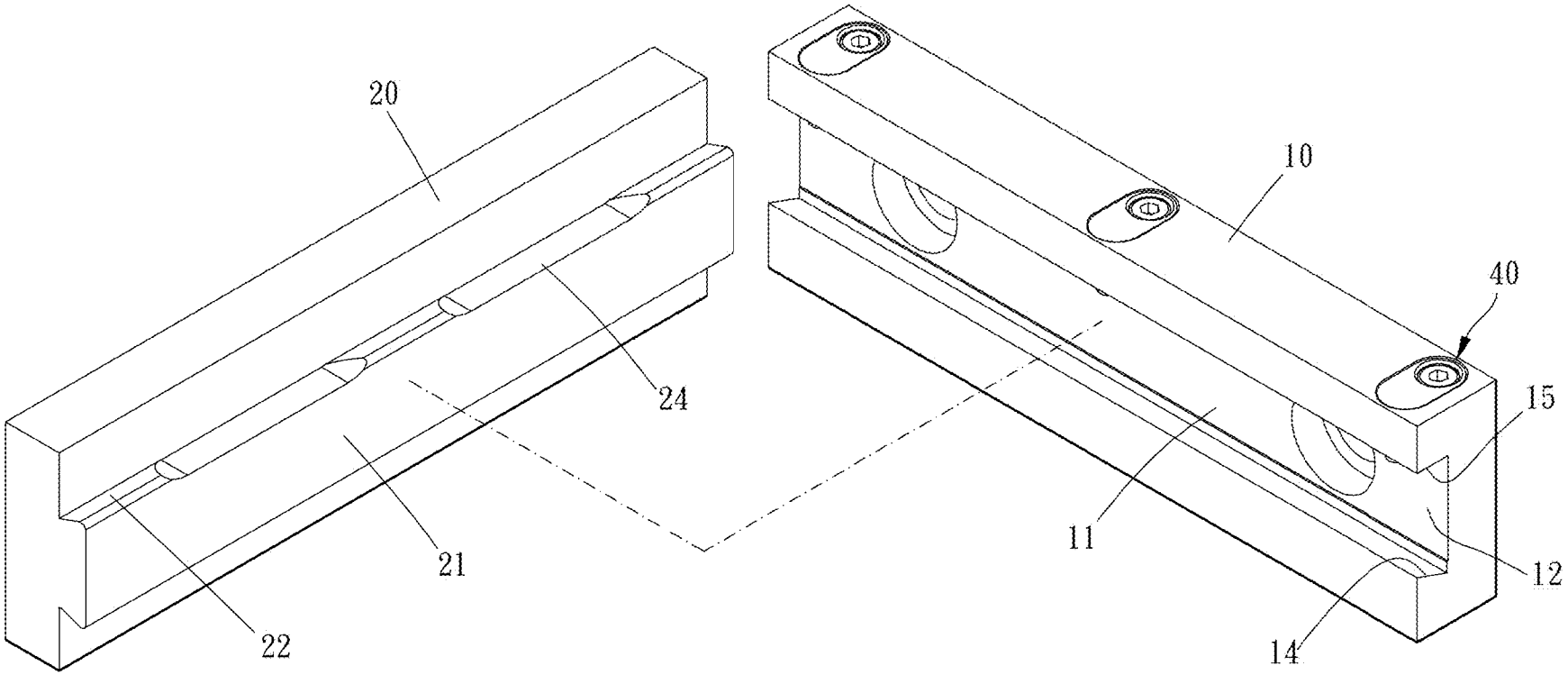
FIG. 2 is breakdown drawing of the first embodiment of the present invention.
Figure 3:
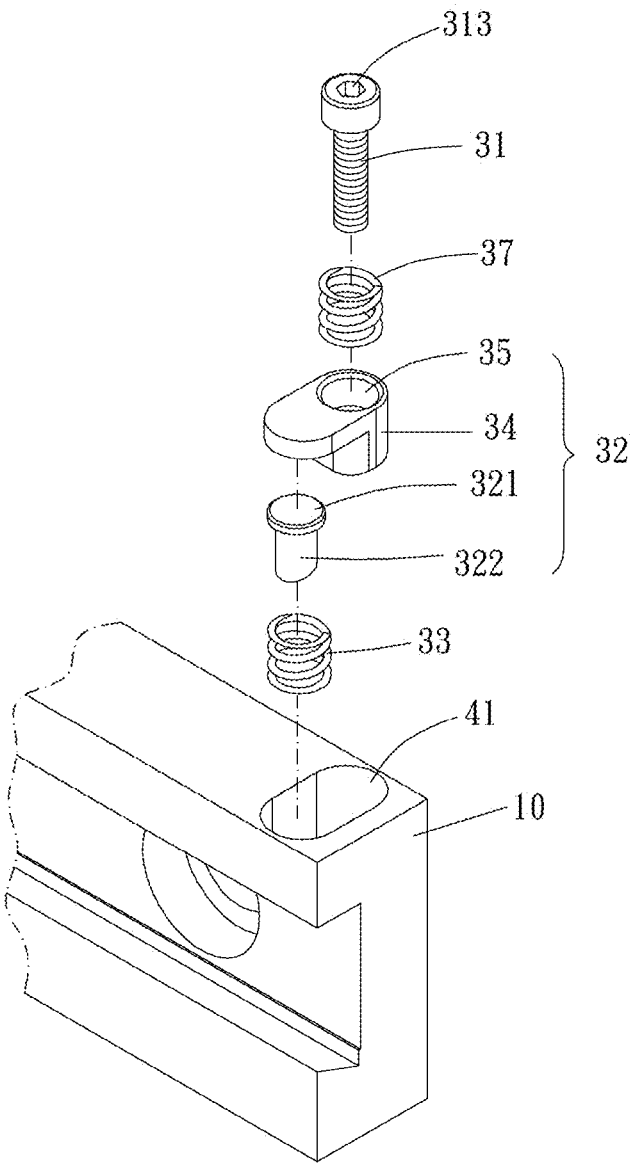
FIG. 3 is another breakdown drawing of the first embodiment of the present invention.
Figure 4:
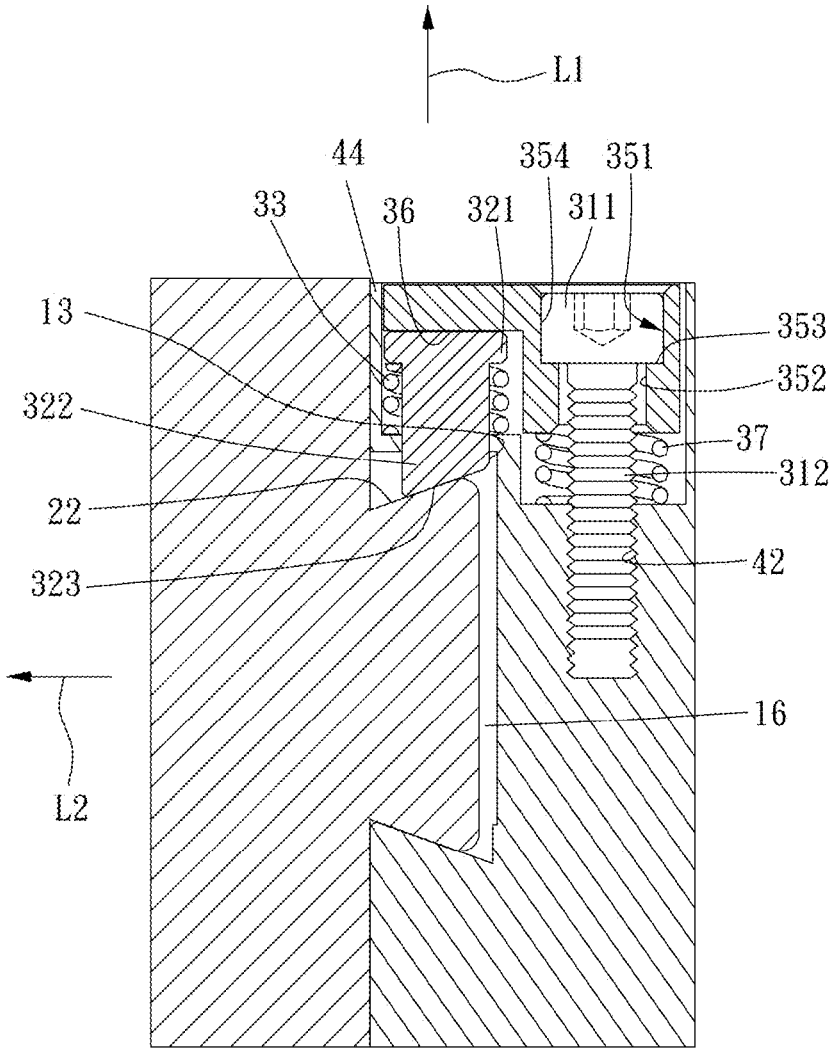
FIG. 4 is a cross-sectional view, taken along line A-A in FIG. 1.
Figure 5:
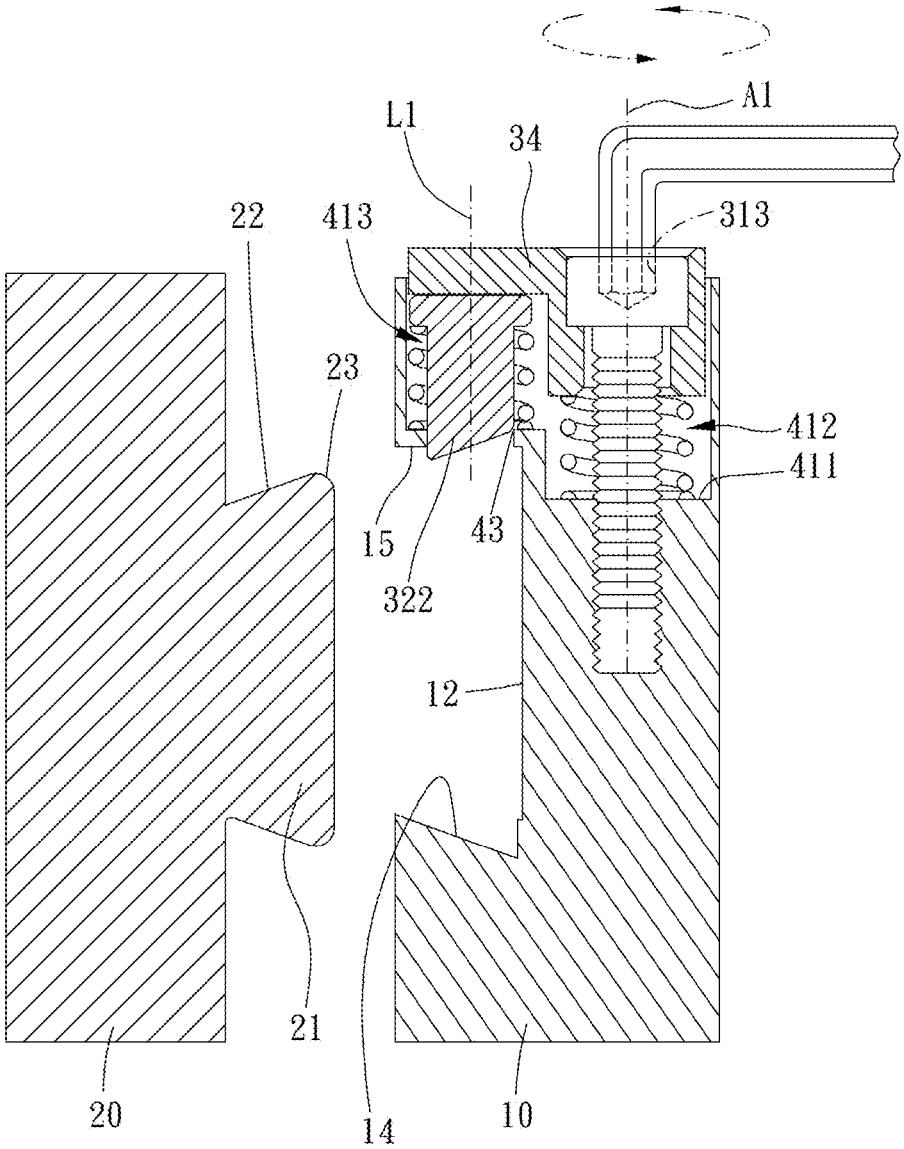
FIG. 5 is a drawing of the first embodiment of the present invention in use.
Figure 6:
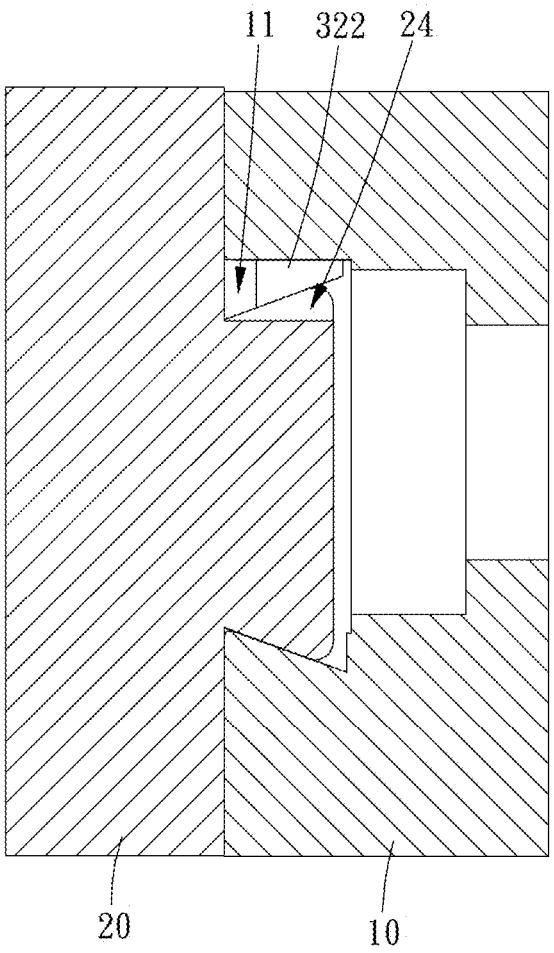
FIG. 6 is a cross-sectional view, taken along line B-B in FIG. 1.
Figure 7:
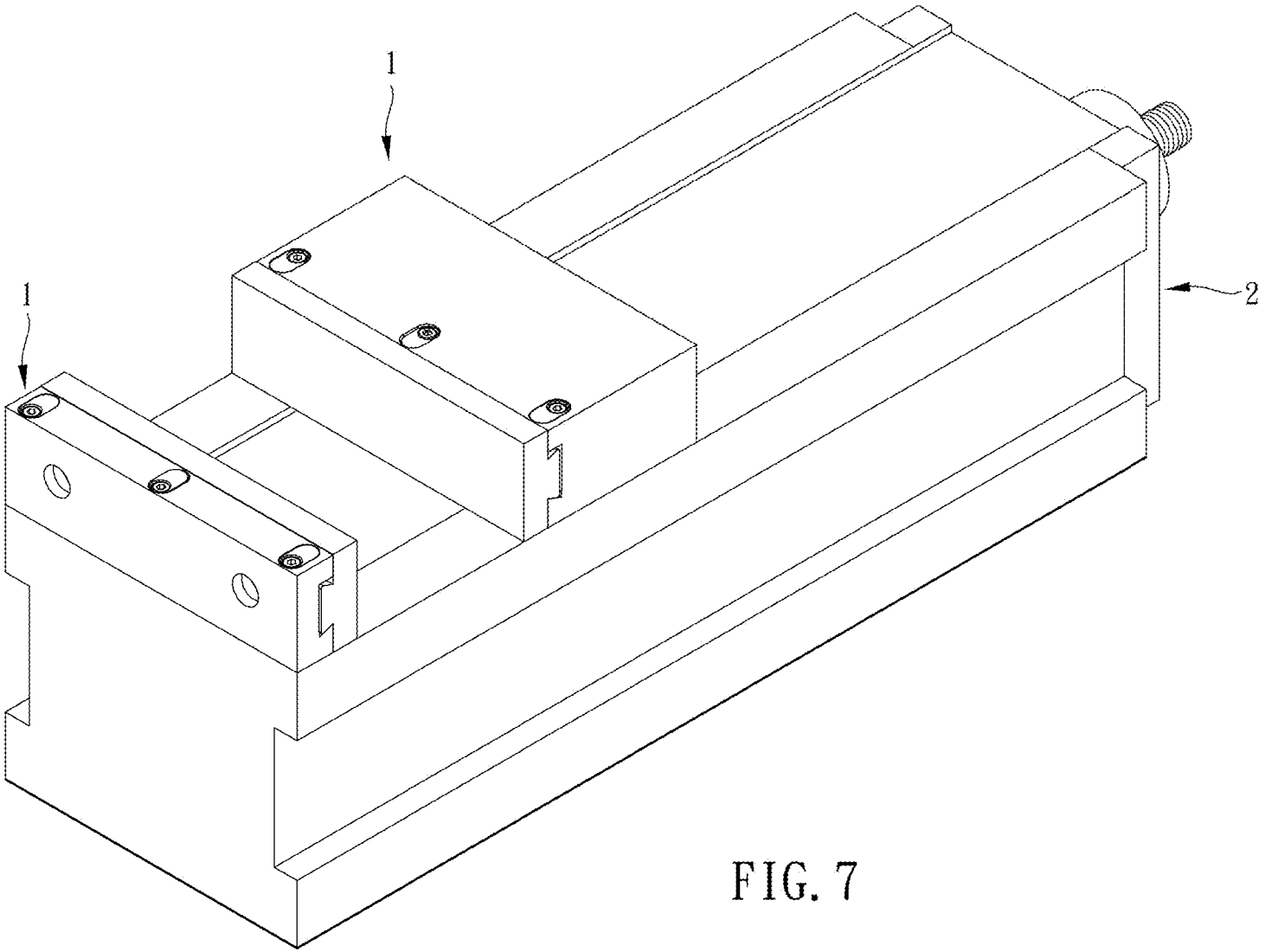
FIG. 7 is another drawing of the first embodiment of the present invention in use.

FIGS. 1 to 7 show a vise jaw according to a first preferred embodiment of the present invention. The vise jaw 1 includes a first jaw 10, a second jaw 20 and at least one fastening assembly 30. The vise jaw 1 is configured to be assembled to a vise seat 2.

The first jaw 10 includes a slide groove 11 and at least one locking portion 40, each of the at least one locking portion 40 includes a receiving room 41, a threaded hole 42 and a through hole 43, and the receiving room 41, the threaded hole 42 and the through hole 43 are respectively communicated with each other. The second jaw 20 has a slide protrusion 21 slidably disposed within the slide groove 11, the slide protrusion 21 has a lateral face 22 facing the through hole 43. The second jaw 20 may be a soft jaw. Each of the fastening assembly 30 includes a screw member 31, an abutting member 32 and at least one elastic member. The screw member 31 is screwed into the threaded hole 42, the abutting member 32 is adjustably disposed within the receiving room 41. The abutting member 32 includes a large diameter section 321 and a small diameter section 322. The large diameter section 321 and the small diameter section 322 are arranged along a first direction L1, the small diameter section 322 is disposed through the through hole 43 and extends into the slide groove 11. Wherein the screw member 31 is screwed to move in the first direction L1 to press the abutting member 32 so that the small diameter section 322 of the abutting member 32 is moved relatively to the through hole 43 to press the lateral face 22, at least one said elastic member elastically abuts between the abutting member 32 and an inner wall 411 of the receiving room 41.

Whereby, the first jaw 10 and the second jaw 20 can be quickly assembled or disassembled, and the first jaw 10 and the second jaw 20 can be securely engaged with each other. Moreover, the small diameter section 322 can apply high pressing force on the slide protrusion 21. Furthermore, the small diameter section 322 can extend deep into the receiving room 41 to keep the small diameter section 322 pressing the slide protrusion 21 so as to provide an excellent positioning effect.

In this embodiment, a number of the at least one locking portion 40 and a number of the at least one fastening assembly 30 are respectively plural, thus improving engagement between the first jaw 10 and the second jaw 20.

Preferably, the at least one fastening assembly 30 includes two said elastic members. The two elastic member includes an elastic member 33 and an elastic member 37.

Preferably, the elastic member 33 sleeves on the small diameter section 322 and elastically abuts between the large diameter section 321 and the receiving room 41. In this embodiment, the elastic member 33 is a torsion spring, the elastic member 33 can stably and elastically bias the abutting member 32, and the elastic member 33 can elastically recover.

The slide protrusion 21 has a recess portion 24 extending toward the first direction L1. The recess portion 24 and the slide groove 11 are spaced in interval to decrease a contact area between the slide protrusion 21 and the slide groove 11 so that the second jaw 20 can be smoothly moved relative to the first jaw 10.

The small diameter section 322 is a column. The screw member 31 defines an axial line A1. The first direction L1 is non-coaxial with the axial line A1, which improves the pressing force of the small diameter section 322 on the slide protrusion 21. The screw member 31 has a polygonal hole 313 configured for assembling of a tool, for stably assemble or disassemble the screw member 31.

The abutting member 32 further includes a base portion 34. The base portion 34 has a via hole 35. The screw member 31 is disposed through the via hole 35. The base portion 34 has an abutting face 36 which is out of the via hole 35 and extends radially to correspond to the large diameter section 321, the elastic member 37 abuts between the base portion 34 and the receiving room 41, and the elastic member 37 sleeves on the screw member 31 to elastically bias the screw member 31. The screw member 31 is screwed to move the abutting face 36 of the base portion 34 to abut against the large diameter section 321 so that the small diameter section 322 is moved to abut against the lateral face 22. As a result, the large diameter section 321 and the small diameter section 322 can be moved by the base portion 34. The via hole 35 is a stepped hole, the via hole 35 includes a large diameter hole 351, a small diameter hole 352 and a shoulder portion 353. The screw member 31 is a countersunk flat head screw, the countersunk flat head screw includes a head section 311 and a body section 312. The head section 311 is disposed within the large diameter hole 351 and not beyond one end of the large diameter hole 351. The head section 311 abuts against the shoulder portion 353, the body section 312 is disposed through the small diameter hole 352, the head section 311 radially abuts against an inner wall 354 of the large diameter hole 351. The screw member 31 is stably moved to stably move the base portion 34.

The receiving room 41 opens toward the first direction L1; the slide groove 11 opens toward an opening direction L2, the opening direction L2 is transverse to the first direction L1. The slide groove 11 includes a bottom face 12, the bottom face 12 is arranged in the opening direction L2 and faces the slide protrusion 21, the small diameter section 322 and the bottom face 12 have a gap 13 therebetween, so that the small diameter section 322 can be moved smoothly without interfering with the bottom face 12.

Specifically, the slide groove 11 includes an inclined lateral wall 14 and a straight lateral wall 15. The inclined lateral wall 14 and the straight lateral wall 15 are respectively connected with two opposite sides of the bottom face 12. The straight lateral wall 15 is perpendicular to the bottom face 12. The slide protrusion 21 is a dovetailed protrusion. The lateral face 22 faces the straight lateral wall 15, a corner 23 of the dovetail protrusion is non-contact with an intersection of the straight lateral wall 15 and the bottom face 12, so that the slide protrusion 21 can be quickly disengaged from the slide groove 11 in the opening direction L2. Specifically, the slide protrusion 21 can dodge the straight lateral wall 15 and be partially tilted out of the slide groove 11 before being totally disengaged from the slide groove 11. Furthermore, the slide protrusion 21 can be engaged with the slide groove 11. Preferably, the lateral face 22 is an inclined face, the small diameter section 322 has an inclined abutting face 323. The inclined abutting face 323 abuts against the inclined face. The slide protrusion 21 and the bottom face 12 have a gap 16 therebetween. A size of the inclined abutting face 323 is small than a size of the inclined face. The inclined abutting face 323 extends towards the bottom face 12 and beyond the inclined face. Thus, when the inclined toothed face 33 is abutted against the inclined face, the slide protrusion 21 can be moved toward the bottom face 12 to securely engage the second jaw 20 with the first jaw 10.

The receiving room 41 includes a deep slot 412 and a shallow slot 413. The deep slot 412 and the shallow slot 413 are arranged along the opening direction L2. The through hole 43 is disposed through a wall of the shallow slot 413, the threaded hole 42 is disposed through the deep slot 412, the large diameter section 321 and the small diameter section 322 are disposed within the shallow slot 413, the small diameter section 322 extends towards the lateral face 22 and beyond one end of the base portion 34, so as to securely abut against the slide protrusion 21.

Each of the at least one the locking portion 40 further has a partition wall 44. The partition wall 44 is disposed between each of the at least one small diameter section 322 and the second jaw 20. The second jaw 20 and the small diameter section 322 do not interfere with each other to prevent from wearing and tearing.

Figure 8:
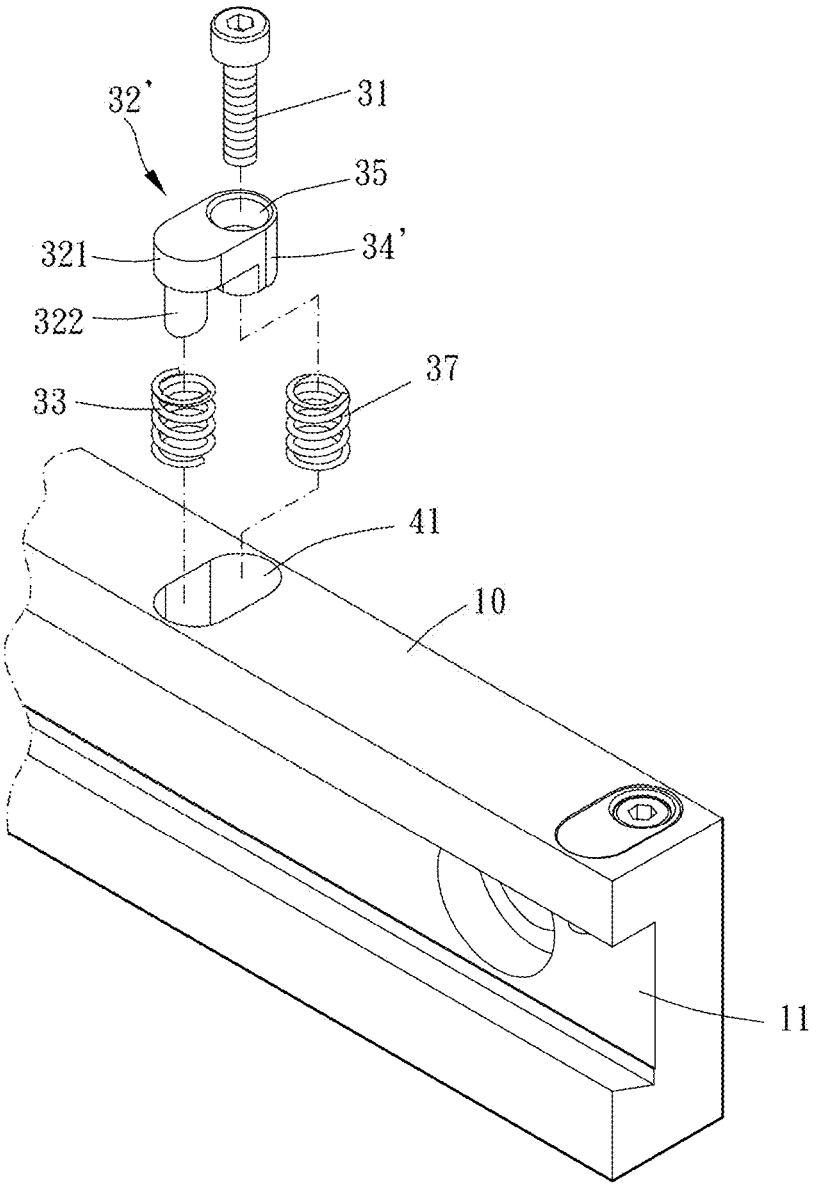
FIG. 8 is a breakdown drawing of a second embodiment of the present invention.
Figure 9:
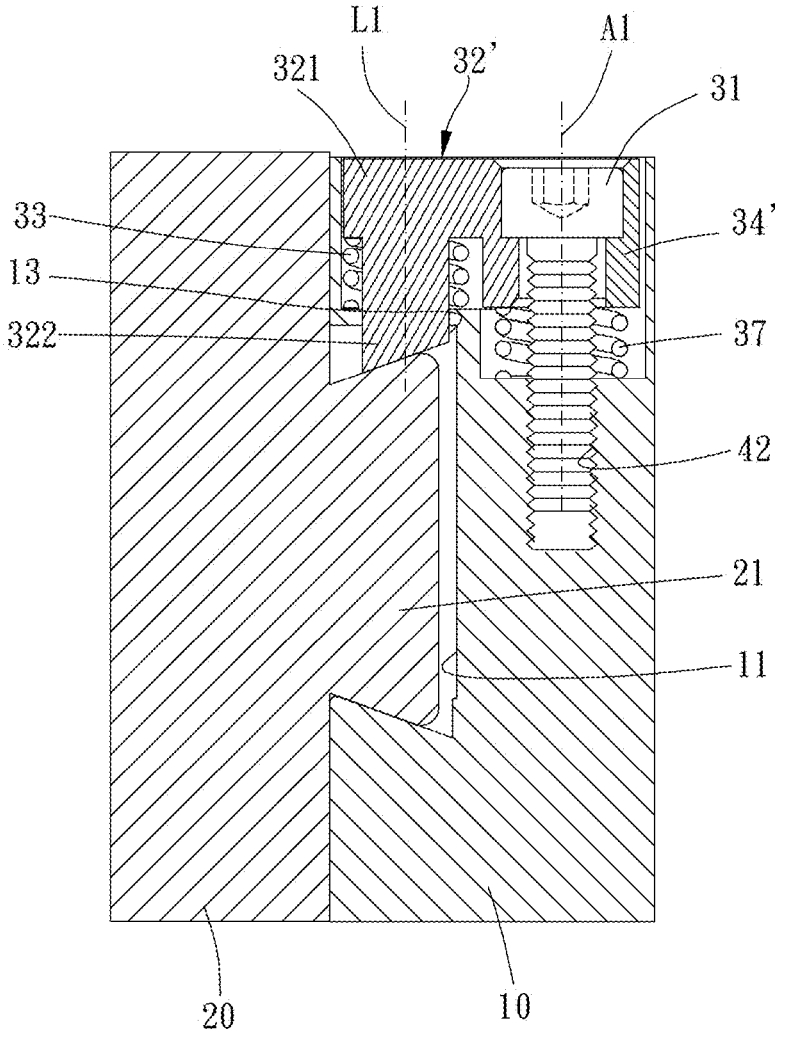
FIG. 9 is a cross-sectional view of the second embodiment of the present invention.

Please refer to FIGS. 8-9 for a second preferred embodiment. In the second preferred embodiment, the large diameter section 321 of the abutting member 32' further includes a base portion 34' protruding therefrom and being transverse to the first direction L1. The base portion 34', the large diameter section 321 and the small diameter section 322 are formed of one piece. The base portion 34' has the via hole 35. The screw member 31 is disposed through the via hole 35, so as to simplify manufacturing processes and reduce manufacturing cost. Moreover, the screw member 31 can directly press the small diameter section 322.

Figure 10:
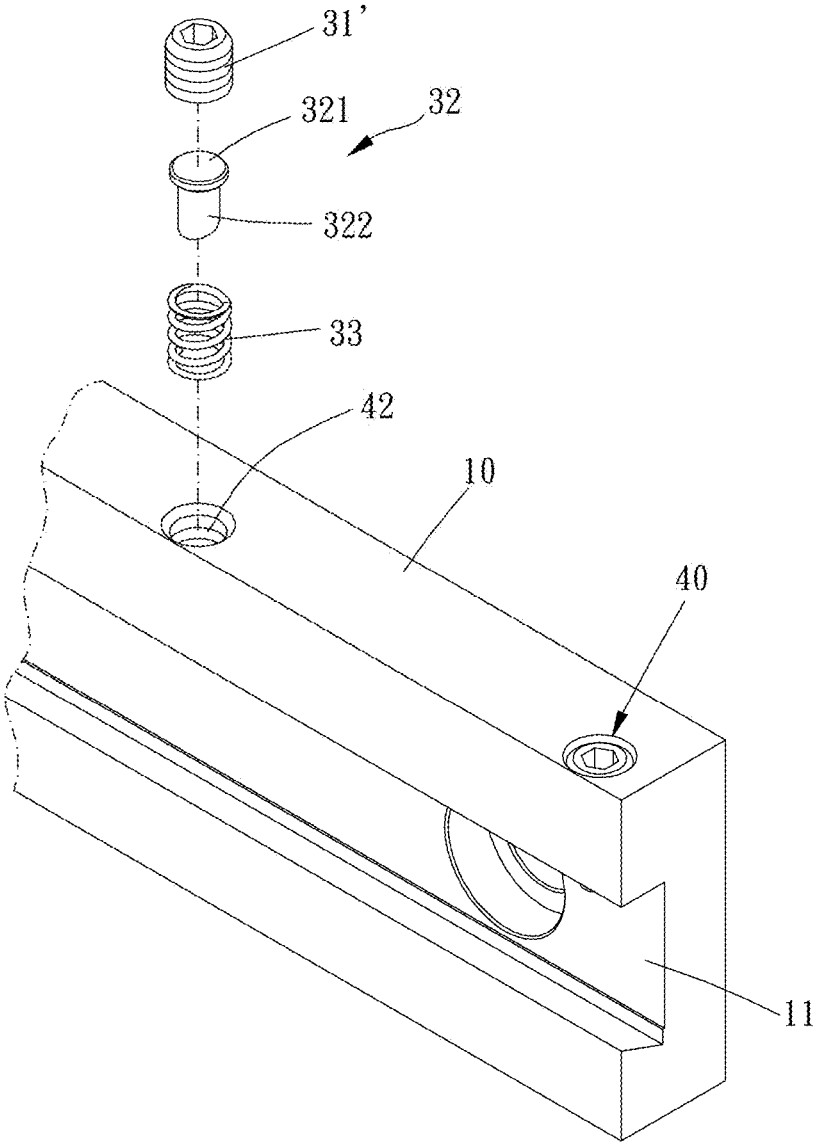
FIG. 10 is a breakdown drawing of a third embodiment of the present invention.
Figure 11:
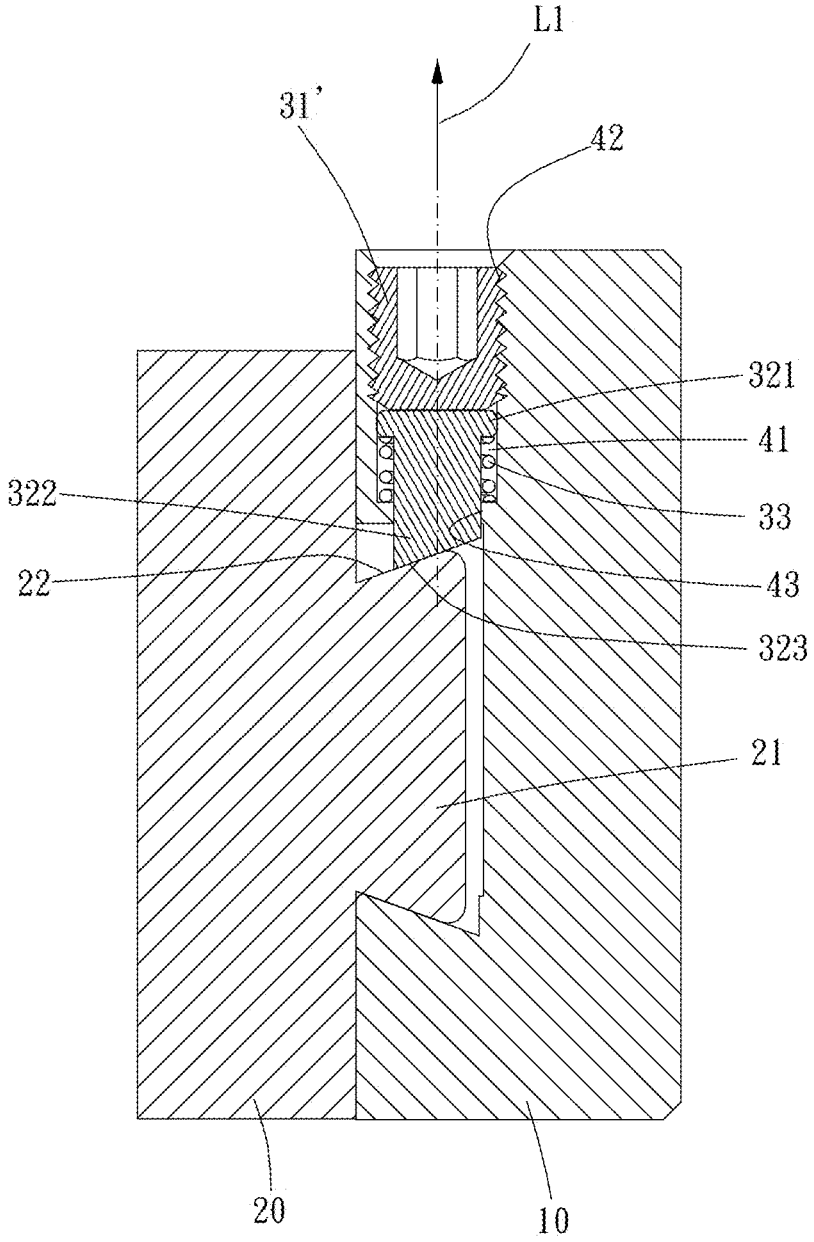
FIG. 11 is a cross-sectional view of the third embodiment of the present invention.

Please refer to FIGS. 10-11 for a third preferred embodiment. In the third preferred embodiment, the first direction L1 passes through the screw member 31', the abutting member 32 and the through hole 43, so as to reduce the whole size. In this embodiment, the screw member 31' directly presses the large diameter section 321. Moreover, in this embodiment, it only needs the elastic member 33 sleeved on the small diameter section 322, and none of the base portion mentioned above is needed.

Figure 12:
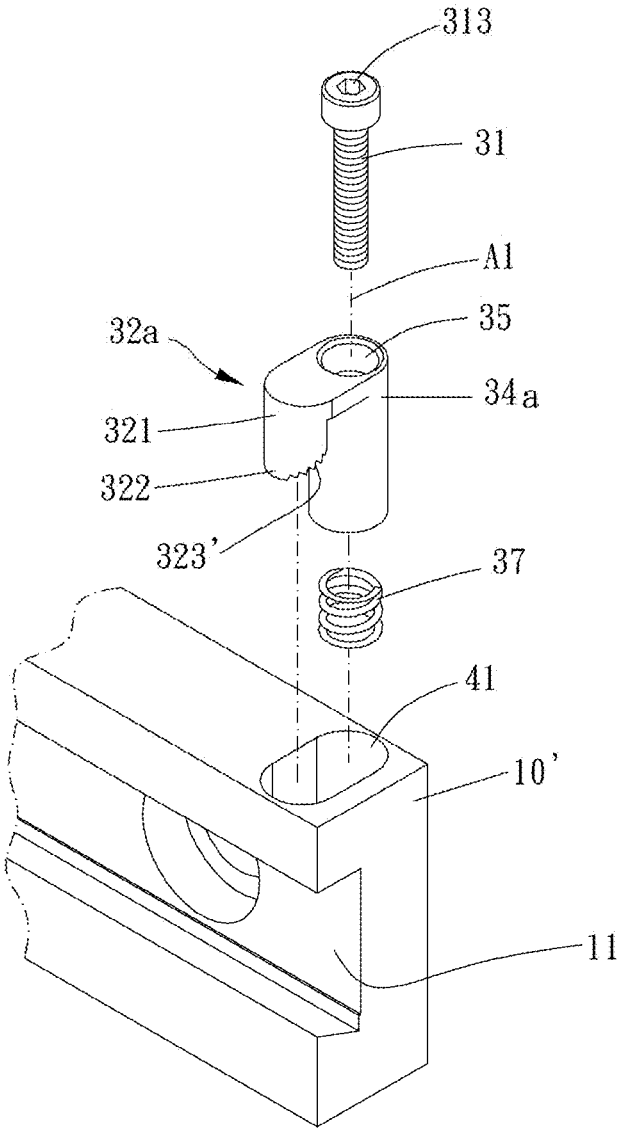
FIG. 12 is a breakdown drawing of a fourth embodiment of the present invention.
Figure 13:
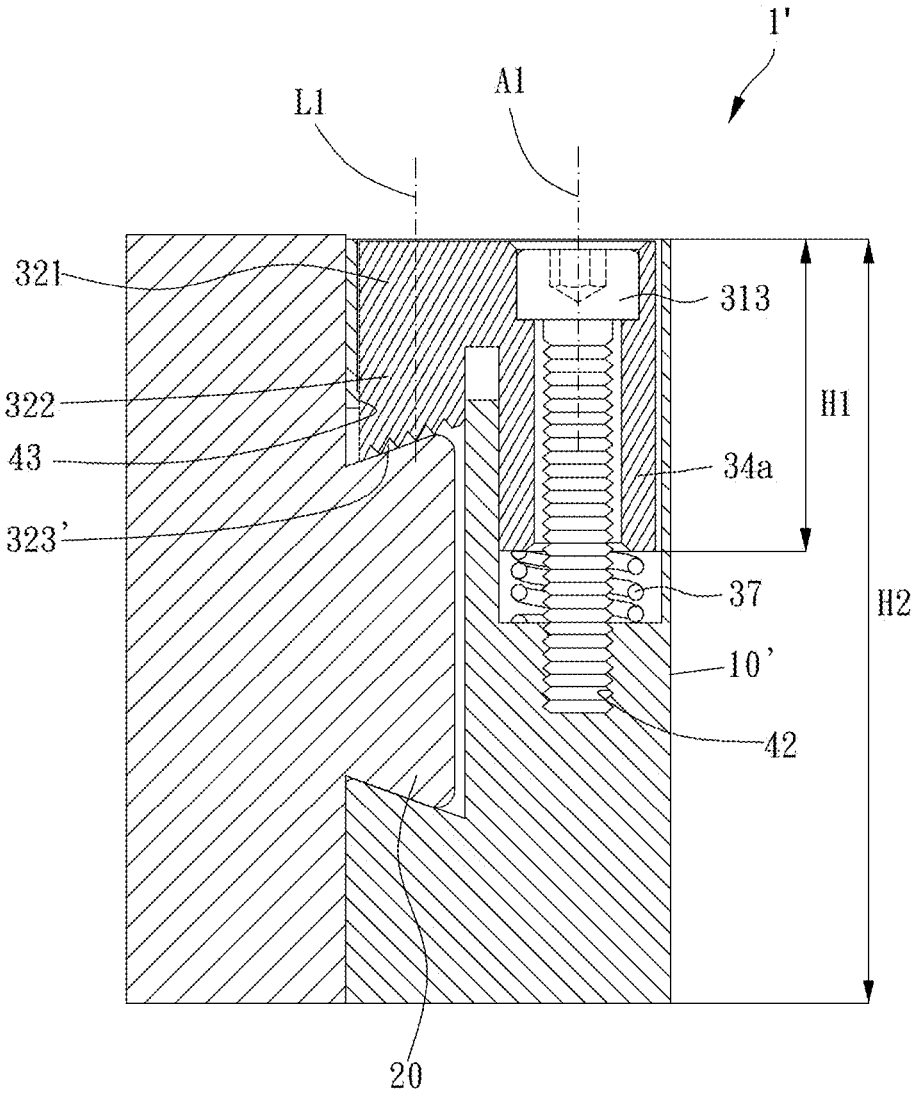
FIG. 13 is a cross-sectional view of the fourth embodiment of the present invention.

Please refer to FIGS. 12-13 for a fourth preferred embodiment. In the fourth preferred embodiment, the vise jaw 1' only has the elastic member 37 and has none of the elastic member 33 mentioned in the second embodiment (FIG. 9). The abutting member **32*a* includes the base portion 34*a*. A size H1 of the base portion 34*a* is greater than ⅓ times a size H2 of the first jaw 10' in a direction along the axial line A1, so that the abutting member 32*a* is not easy to rock and flip relatively to the first jaw 10'. The small diameter section 322 is a non-cylindrical rod. As viewed in the first direction L1, a circumferential face of the small diameter section 322 and a circumferential face of the large diameter section 321 are flush with each other, which provides strong engagement of the second jaw 20 and the first jaw 10. Preferably, the small diameter section 322 has an inclined toothed face 323'** so as to provide a better engagement and the excellent positioning effect.

By utilizing the at least one fastening assembly, it provides quick dis/assembling and secure engagement of the first jaw and the second jaw.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A vise jaw, including:

a first jaw, including a slide groove and at least one locking portion, each of the at least one locking portion including a receiving room, a threaded hole and a through hole; the receiving room, the threaded hole and the through hole respectively communicated with each other;

a second jaw, having a slide protrusion slidably disposed within the slide groove, the slide protrusion having a lateral face facing the through hole;

at least one fastening assembly, each of the at least one fastening assembly including a screw member, an abutting member and at least one elastic member; the screw member screwed into the threaded hole, the abutting member adjustably disposed within the receiving room, the abutting member including a large diameter section and a small diameter section, the large diameter section and the small diameter section arranged along a first direction, the small diameter section disposed through the through hole and extending into the slide groove;

wherein the screw member is screwed to move in the first direction to press the abutting member so that the small diameter section of the abutting member is moved relatively to the through hole to press the lateral face, said at least one elastic member elastically abuts between the abutting member and an inner wall of the receiving room;

wherein the small diameter section is a column, the screw member defines an axial line, and the first direction is non-coaxial with the axial line;

wherein the large diameter section further includes a base portion protruding therefrom and being transverse to the first direction, the base portion has a via hole, the screw member is disposed through the via hole, the at least one elastic member elastically abuts between the base portion and the receiving room, the at least one elastic member sleeves on the screw member; the base portion, the large diameter section and the small diameter section are formed of one piece, and a size of the base portion is greater than ⅓ times a size of the first jaw in a direction along the axial line.

2. The vise jaw of claim 1, wherein one of the at least one elastic member sleeves on the small diameter section and elastically abuts between the large diameter section and the inner wall of the receiving room.

3. The vise jaw of claim 1, wherein the at least one elastic member includes two elastic members, one of the two elastic members sleeves on the small diameter section and elastically abuts between the large diameter section and the receiving room, the other of the two elastic members elastically abuts between the base portion and the receiving room and sleeves on the screw member.

4. The vise jaw of claim 3, wherein the receiving room opens toward the first direction; the slide groove opens toward an opening direction, the opening direction is transverse to the first direction, the slide groove includes a bottom face, the bottom face is arranged in the opening direction and faces the slide protrusion, the small diameter section and the bottom face have a gap therebetween; the slide groove includes an inclined lateral wall and a straight lateral wall, the inclined lateral wall and the straight lateral wall are respectively connected with two opposite sides of the bottom face of the slide groove, the straight lateral wall is perpendicular to the bottom face, the slide protrusion is a dovetailed protrusion, the lateral face faces the straight lateral wall, a corner of the dovetailed protrusion is non-contact with an intersection of the straight lateral wall and the bottom face; the lateral face is an inclined face, the smaller diameter section has an inclined abutting face, the inclined abutting face abuts against the inclined face, a size of the inclined abutting face is small than a size of the inclined face; a number of the at least one locking portion and a number of the at least one fastening assembly are respectively plural; the receiving room includes a deep slot and a shallow slot, the deep slot and the shallow slot are arranged along the opening direction, the through hole is disposed through a wall of the shallow slot, the threaded hole is disposed through the deep slot, the large diameter section and the small diameter section are disposed within the shallow slot, the small diameter section extends towards the lateral face and beyond one end of the base portion; the inclined abutting face extends towards the bottom face and beyond the inclined face; the via hole is a stepped hole, the via hole includes a large diameter hole, a small diameter hole and a shoulder portion, the screw member is a countersunk flat head screw, the countersunk flat head screw includes a head section and a body section, the head section is disposed within the large diameter hole and not beyond one end of the large diameter hole, the head section abuts against the shoulder portion, the body section is disposed through the small diameter hole, the head section radially abuts against an inner wall of the large diameter hole; the slide protrusion has a recess portion extending toward the first direction; each of the at least one the locking portion further has a partition wall, the partition wall is disposed between each of the at least one small diameter section and the second jaw.

5. The vise jaw of claim 1, wherein as viewed in the first direction, a circumferential face of the small diameter section and a circumferential face of the large diameter section are flush with each other.

6. The vise jaw of claim 1, wherein the base portion has an abutting face which is out of the via hole and extends radially to correspond to the large diameter section, the at least one elastic member includes two elastic members, and one of the two elastic members sleeves on the small diameter section and abuts between the large diameter section and the receiving room, the other of the two elastic members abuts between the base portion and the receiving room.

7. The vise jaw of claim 1, wherein the slide groove includes an inclined lateral wall and a straight lateral wall, the inclined lateral wall and the straight lateral wall are respectively connected with two opposite sides of a bottom face of the slide groove, the straight lateral wall is perpendicular to the bottom face, the slide protrusion is a dovetailed protrusion, the lateral face faces the straight lateral wall, the lateral face is an inclined face, the small diameter section has an inclined toothed face, and the inclined toothed face abuts against the inclined face.

8. The vise jaw of claim 1, wherein the receiving room opens toward the first direction; the slide groove opens toward an opening direction, the opening direction is transverse to the first direction, the slide groove includes a bottom face, the bottom face is arranged in the opening direction and faces the slide protrusion; and the slide protrusion and the bottom face have a gap therebetween.

* * * * *